US005443419A

United States Patent [19]

Adams et al.

[11] Patent Number: 5,443,419

[45] Date of Patent: Aug. 22, 1995

[54] COLLECTOR ASSEMBLY FOR COIN HANDLING MACHINE

[75] Inventors: Thomas P. Adams, Oconomowoc; Joseph P. Hanus, Johnson Creek; Kenneth G. Ebenhoch, Mukwonago; Roger Klemp, Watertown, all of Wis.

[73] Assignee: Brandt, Inc, Watertown, Wis.

[21] Appl. No.: 213,322

[22] Filed: Mar. 15, 1994

[51] Int. Cl.[6] ..... B65B 57/06; G07D 3/00

[52] U.S. Cl. ..... 453/17; 453/63; 53/67

[58] Field of Search ..... 453/3–15, 453/17, 18, 31, 63; 53/67

[56] References Cited

U.S. PATENT DOCUMENTS

| | | | |
|---|---|---|---|
| 4,285,351 | 8/1981 | Nyffenegger | 453/17 |
| 4,586,522 | 5/1986 | Taipale et al. | 453/10 |
| 5,295,899 | 3/1994 | Adams et al. | 453/10 |
| 5,297,598 | 3/1994 | Rasmussen | 141/314 |

OTHER PUBLICATIONS

Brandt Model 6500 Series High Speed Coin Sorter and Counter Maintenance Manual, 1993, Introduction and Sections Nos. 1, 5, 6, and 8.

*Primary Examiner*—F. J. Bartuska
*Attorney, Agent, or Firm*—Quarles & Brady

[57] ABSTRACT

A coin handling machine such as a coin sorter has a plurality of collectors in the form of drawers or chutes arranged in a circular array and each adapted to receive coins of a particular denomination through its open top. A switch and switch actuator plate are mounted in the center of the array. A spring-loaded pivot lever extends radially from the plate to each collector location. The plate is normally held in a neutral position but will be moved to actuate the switch when any one of the levers is released. The levers are normally held against release by the presence of a collector at each station. Actuation of the switch will disable the operation of the machine. The machine may be mounted on a platform of a stand to which bagging spouts are removably attached beneath the chutes. The spouts are incapable of removal when the machine is in place on the platform.

15 Claims, 4 Drawing Sheets

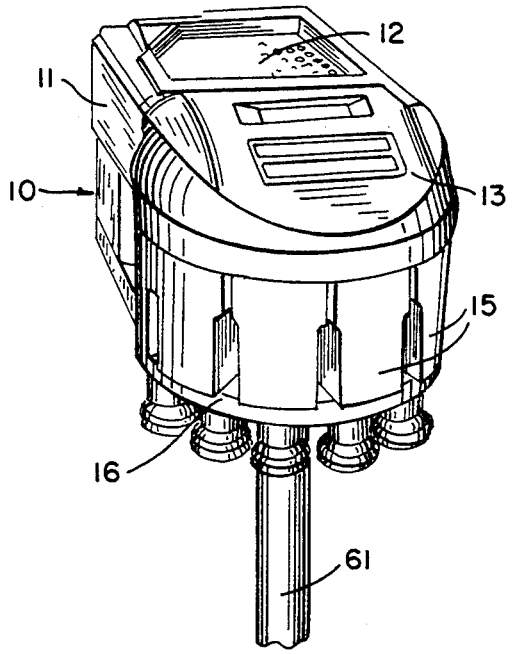
FIG. 1
FIG. 5
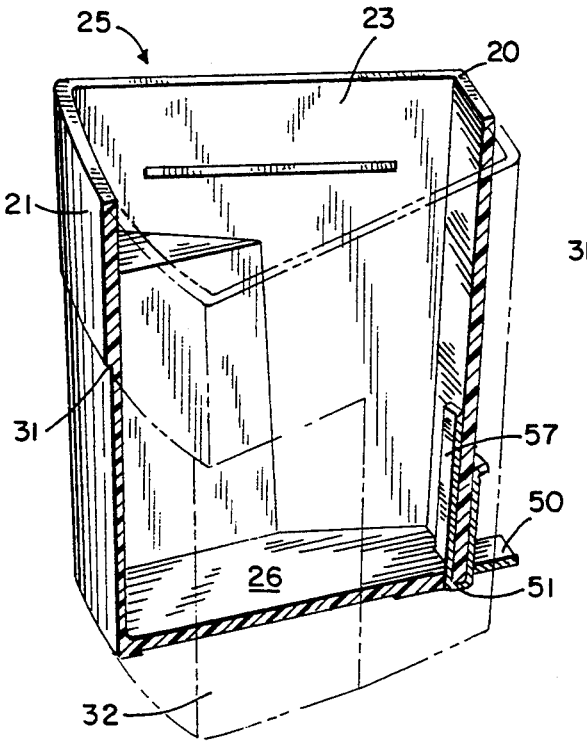
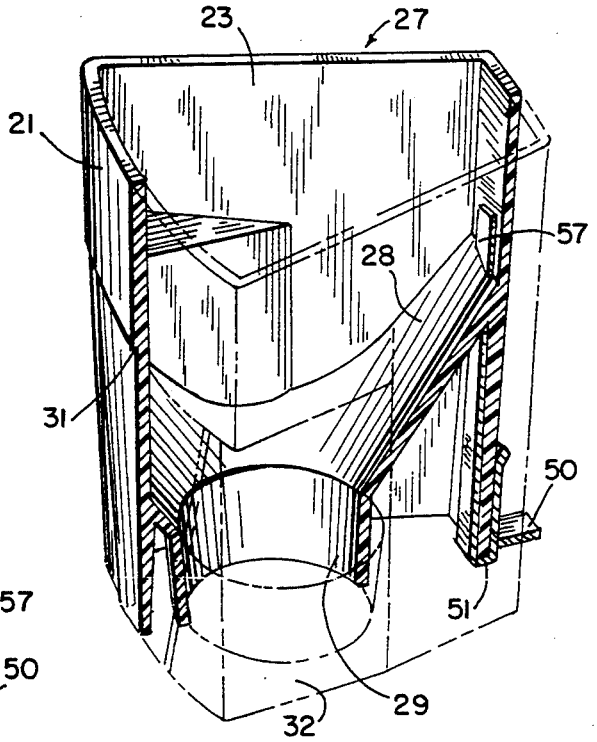
FIG. 6

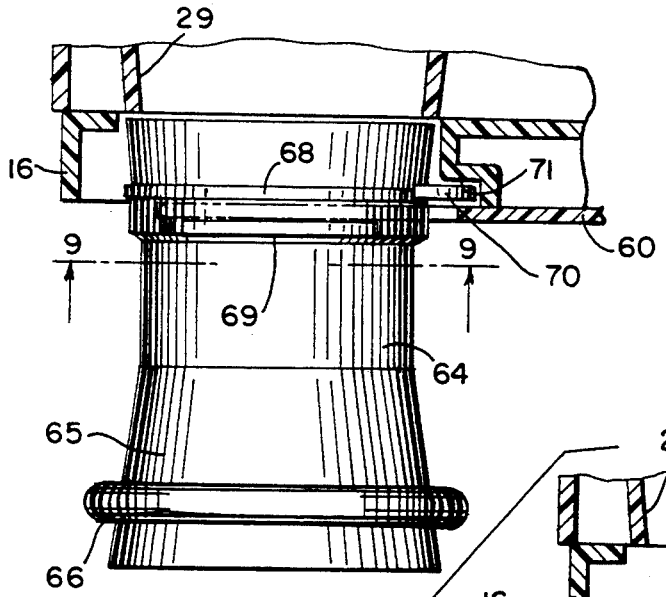
FIG. 7
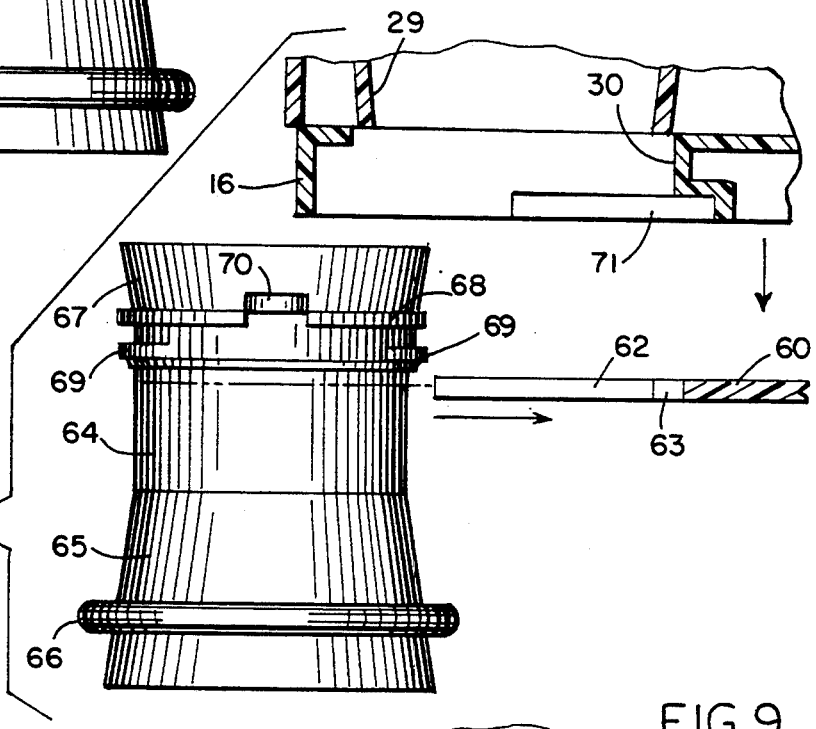
FIG. 8
FIG. 9
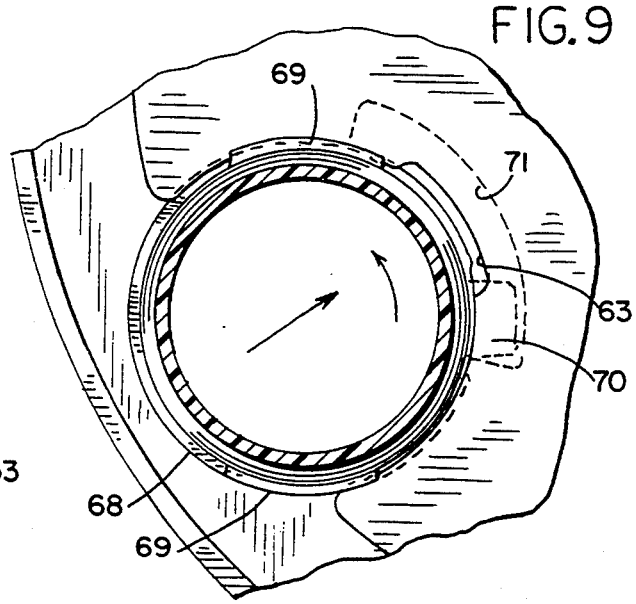
FIG. 10
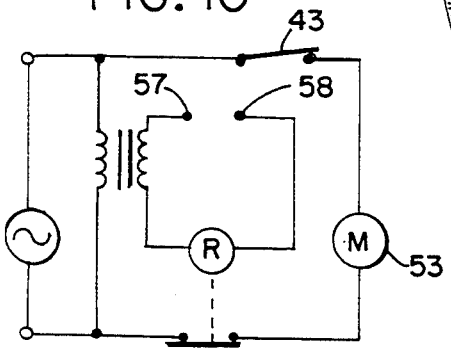

COLLECTOR ASSEMBLY FOR COIN HANDLING MACHINE

BACKGROUND OF THE INVENTION

This invention relates to coin handling equipment, and more particularly to an assembly of collectors for collecting coins ejected from the machine at spaced locations.

A variety of coin handling equipment process coins and eject the coins at spaced locations or stations. A coin sorter, for example, will accept a batch of mixed coins and sort the coins into respective denominations. The typical sorter ejects the coins at spaced locations on the machine where the coins are collected in collectors such as drawers or bags. When the machine is in operation, it is important that a drawer or bag be present to catch the coins being ejected.

In the past, a switch has been provided at a particular drawer location or station to sense the presence of a drawer. Also, the typical spout to which bags are attached has a ring that helps to hold the bags in place. The position and movement of the ring has been used to indicate when it is likely that a bag is present.

SUMMARY OF THE INVENTION

In accordance with the invention, a coin handling machine with a plurality of spaced stations at which coins are ejected includes a shelf beneath the stations for supporting a collector at each station. There are a plurality of collectors, one for each station. A switch is connected to disable the operation of the machine when actuated, and an actuator for the switch is provided that is responsive to the presence of all of the collectors in place at all of the stations to actuate the switch when any one of the collectors is absent. The collectors may be an open top drawer that rests on the shelf with a closed bottom or may be a chute with an open top and an internal funnel that leads to a bottom opening that registers with an opening in the shelf. A bagging spout is adapted to be mounted beneath the shelf opening.

Further in accordance with the invention, the actuator comprises a plate engageable with the switch but normally held in a neutral plane. Levers are mounted at each station to move the plate from the neutral plane when released to actuate the switch. Each collector engages its respective lever against release when it is in place on the shelf.

The invention is particularly useful when the spaced stations are arranged in a circular array. The plate and switch are then disposed in the center of the array and the levers extend outwardly from the plate in a radial direction to each station. In the preferred embodiment, the levers are pivoted intermediate their ends with one end beneath the plate for engagement therewith and the other end engageable with the collector. A leaf spring bears against the underside of the first end to urge that end into engagement with the plate. The collector may be provided with a metal bracket for engagement with the lever. The leaf spring, lever, and bracket may form one half of an electrical circuit which is completed by coins rising in the collector to a level where they make electrical contact with a contact extending into the open top of the collector above the level of the shelf.

The invention may also reside in a wedge-shaped collector with a narrowed portion with straight sides extending below a waist level for grasping by the human hand.

The invention may further reside in an assembly of bagging spouts mountable on a support platform that supports the shelf and readily removable from such platform except when the shelf is in place on the platform.

The foregoing and other objects and advantages of the invention will appear in the following detailed description of the invention. In the detailed description, reference is made to the accompanying drawings which illustrate preferred embodiments of the invention.

BRIEF DESCRIPTION OF THE DRAWINGS

FIG. 1 is a view in perspective of a coin sorter incorporating the present invention;

FIG. 5 is a view in perspective and partially in section of a drawer form of the collector;

FIG. 6 is a view in perspective and partially in section of a chutes form of the collector;

FIG. 7 is a view in elevation of a bagging spout attached a platform supporting the coin sorter of FIG. 1;

FIG. 8 is an exploded view similar to FIG. 7 but showing the manner of mounting the spout;

FIG. 9 view in section taken in the plane of the line 9—9 in FIG 7; and

FIG. 10 is a simplified circuit diagram showing the interlocks that prevent the operation of the machine when a collector is not in place or a collector has become filled.

DETAILED DESCRIPTION OF THE PREFERRED EMBODIMENTS

Figure 2:
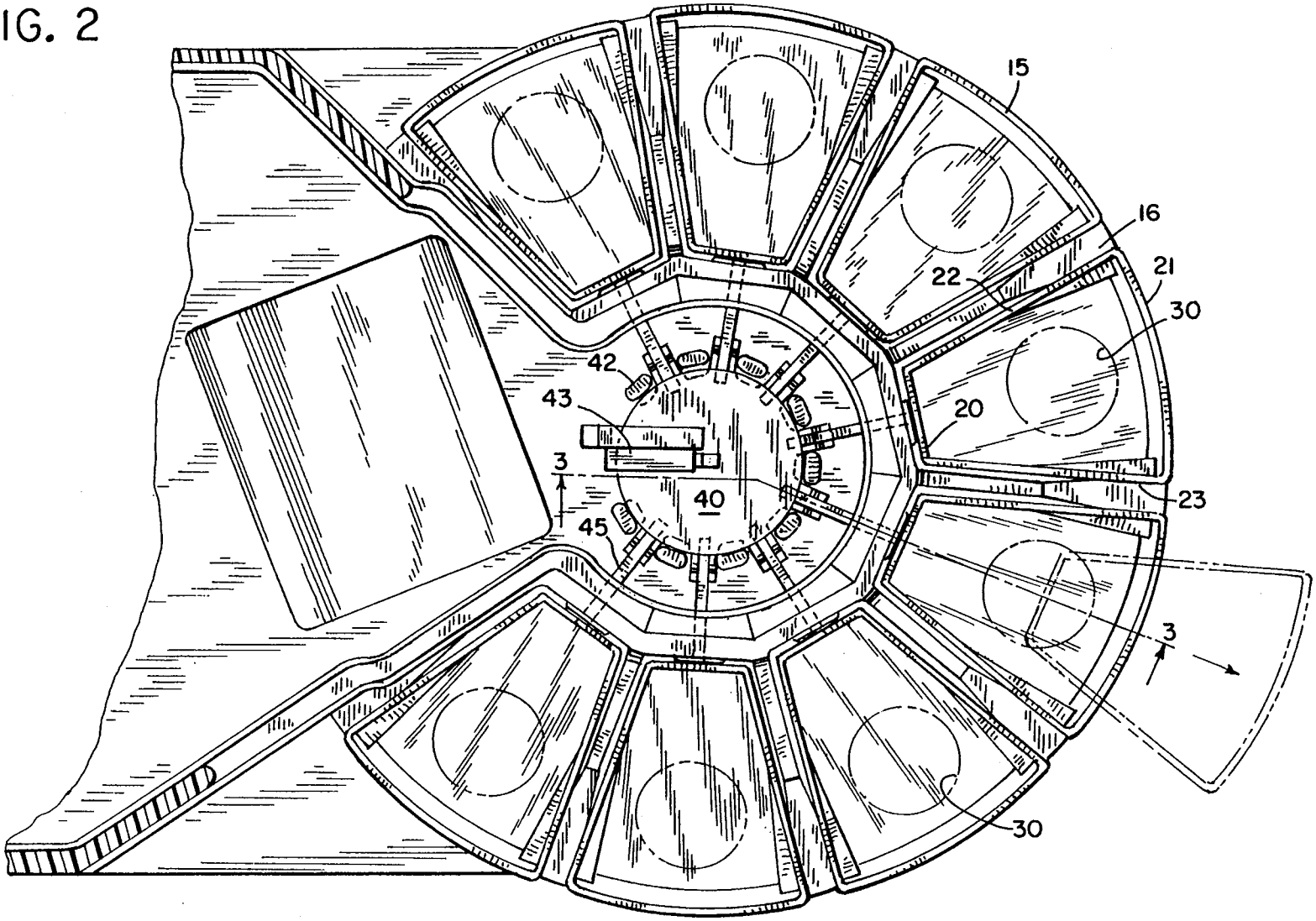
FIG. 2 is a plan view of the collector assembly of the sorter of FIG. 1.

Referring to the drawings, the invention is illustrated as being used in conjunction with a coin sorter having a housing 10 including a top 11 which mounts an inspection pan 12 that overlies the top 11 and a portion of a front hinged cover 13. The sorter mechanism is that illustrated and described in co-pending application Ser. No. 07/845,122 filed Mar. 3, 1992, for "Two Disc Coin Handling Apparatus" that will issue on Mar. 22, 1994, as U.S. Pat. No. 5,295,899. The disclosure of that co-pending application is hereby incorporated by reference as though fully set forth herein. In such coin sorter, coins are deposited on the surface of a rotating disc which forms the coins into a single file in a single layer and feeds the aligned coins to a sorting plate in which the coins exit at spaced openings in the plate depending upon their size. Each denomination of coin to be sorted will be discharged into a respective one of a plurality of collectors 15 that rest upon a shelf 16.

As shown in FIG. 2, the collectors 15 are arranged in a circular array on the shelf 16 and the open top of each collector 15 is to be disposed beneath one of the sorter openings to receive coins of a particular denomination that is sorted at that position or station. The collectors 15 are generally wedge-shaped with an inner face 20 that is straight, an outer face 21 that follows the curve of the circular array, and flat sides 22 and 23 which converge from the larger front face 21 towards the smaller inner face 20. The top of the collectors 15 are open to receive coins ejected from the sorting mechanism. The collectors 15 can take two forms. In one form, as shown in FIG. 5, the collector 15 is a drawer 25 having a closed bottom 26. In a second embodiment, as illustrated in FIG. 6, the collector 15 is a chute 27 having an internally-formed funnel 28 leading to a tubular exit 29. The chute 27 directs coins to an opening 30 in the shelf that registers with the exit 29 when the chute is fully in place on the shelf.

In both embodiments of the collector 15, a portion of the side walls 22 and 23 beneath a waist level 31 is recessed by providing two flat wall segments 32 that extend at a smaller angle of conversion than that of the main side walls 22 and 23. The result is that the collectors 15 can be easily grasped by the human hand at the lower wall segments 32 and the waist 31 will prevent a collector 15 from accidentally slipping through the hand even when it is weighted with coins. The collectors 15 are preferably formed of a synthetic resin material having some resiliency to deaden the sound of coins falling into the collectors 15.

Figure 3:
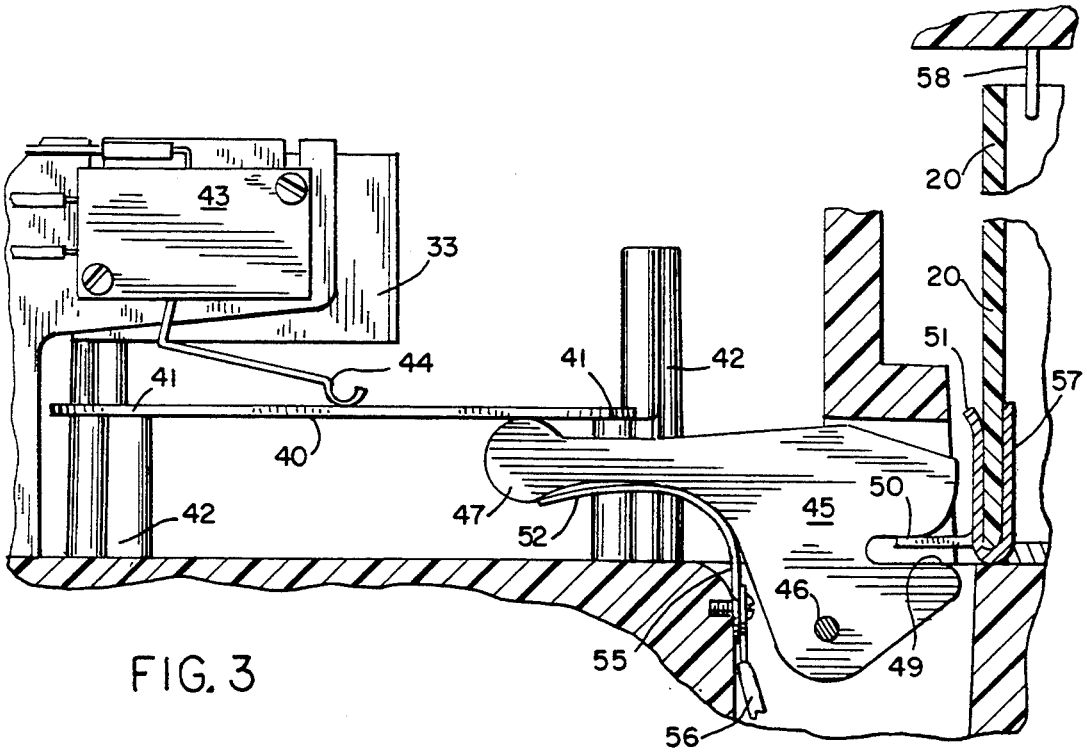
FIG. 3 is a view in vertical elevation and partially in section taken in the plane of the line 3—3 of FIG. 2.
Figure 4:
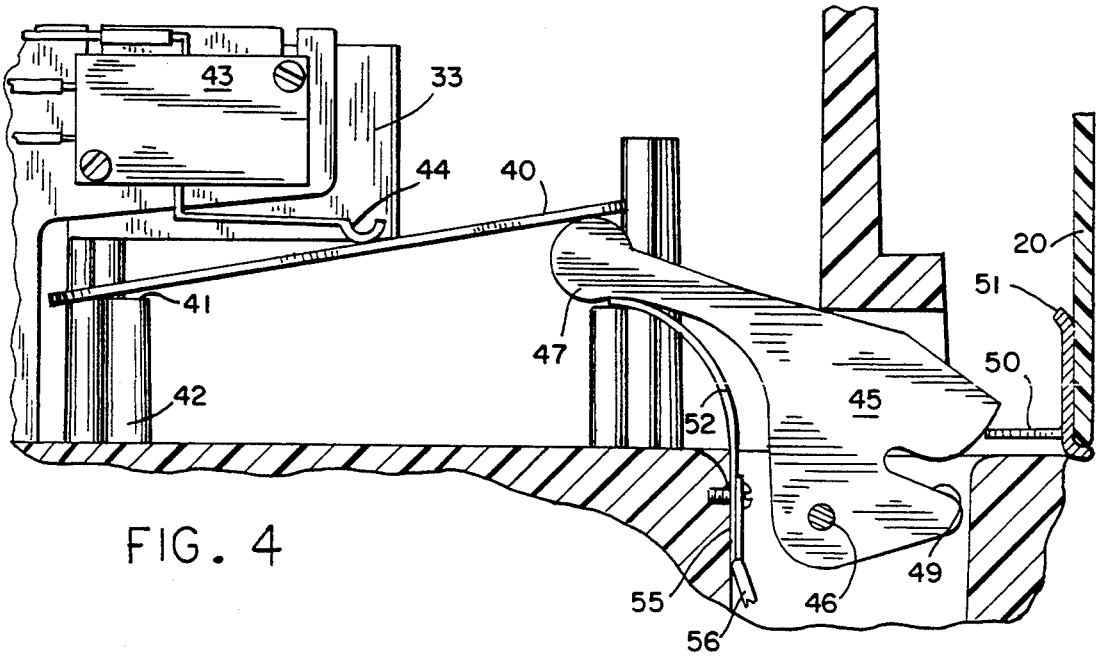
FIG. 4 A is a view similar to FIG. 3 but showing the actuator engaging the switch upon removal of one of the collectors.

Disposed in the center of the array of collectors 15 is a circular actuator plate 40 which rests on ledges 41 formed in a circular array of standards 42. A switch 43 has an actuator arm 44 that engages the center of the circular plate 40. A lever 45 is provided at each station. The lever is mounted on a pivot 46 intermediate its ends. An inner end 47 of each lever 45 is disposed beneath the plate 40. The outer end 48 includes a slot 49 that can be engaged by a bracket 50 projecting from a clip 51 that grasps the inner face 20 of a collector 15. A leaf spring 52 bears against the underside of the inner end 47 of the lever 45 and urges the inner end upwardly. As shown in FIG. 3, when a collector 15 is in place on the shelf 16 and fully inserted at its station, the bracket 50 on that collector 15 will enter the slot 49 and hold the lever 45 in a generally level position against the urgings of the leaf spring 52. In that position, the actuator plate 40 can rest on the ledges 41 undisturbed by the levers 45. However, should any of the drawers be removed, or not in place, the respective lever will be released and the leaf spring 52 will rotate the inner end 47 of the lever 45 upwardly thereby moving the plate 40 from its neutral horizontal position to thereby actuate the switch 43. The removal or absence of any one of the collectors 15 from a completely inserted position on the shelf 16 will result in the actuation of the switch 43. The switch 43 may be connected in a circuit for energizing the motor 53 that operates the sorter such that, when the switch 43 is actuated, power to the motor 53 is removed. A stop bracket 33 limits the extent of movement of the plate 40 and the switch actuator 44.

The leaf springs 52 may be formed from a single stamping of spring steel material with separate leaves 52 extending from a base portion 55. A conductor 56 is connected to the base portion 55. The leaf spring 52, which is conductive, engages the levers 45, which are stamped from metal and are also conductive. The clips 51 may also be formed of metal and include a strip 57 that extends upwardly along the inside of the inner face 20 of each collector. The leaf springs 52 and levers 45 together with the metallic clips 51 form one side of an electric circuit with the strip 57 defining a first contact. A second contact in the form of a conductive O-ring 58 extends downwardly over the shelf 16 at each station and is received into the open top of a collector 15. When the level of coins within a collector 15 reaches the O-ring 58, a circuit will be completed to indicate that a collector 15 is filled. Completion of that circuit will result in the halting of the operation of the sorter so as to prevent overfilling of the collector 15. The coin level sensing circuit is typically at a low voltage such as 5 volts.

Referring to FIGS. 7 through 9, the sorter machine is adapted to be mounted on a stand that includes a horizontal platform 60 mounted at the top of an upright standard 61. The stand may take the form illustrated in the co-pending application of Thomas P. Adams and John B. Ledingham for design for Coin Sorter filed on the same day as this application and whose disclosure is incorporated by reference as if fully set forth herein. The platform 60 is provided with a plurality of spaced slots 62 opening outward and each formed as a portion of a circle with the neck of the opening less than the diameter of the circle. Opposite the opening to each slot 62 is a keyway portion 63 which extends over a minor portion of the perimeter of the slot 62.

The slots 62 are adapted to mount bagging spouts which, as is known in the art, typically have a tubular body 64 terminating in a flared bottom 65 on which a spout ring 66 rests such that a bag can be held between the flared portion 65 and the ring 66. The spouts of the present invention differ from that of the prior art by their manner of mounting and attachment. Specifically, each spout has an upper mounting portion 67 that carries an upper horizontal flange 68 that is essentially continuous around the circumference of the mounting portion 67. Spaced beneath the upper flange 68 are two lower flanges 69 that extend only part of the way around the circumference of the mounting portion 67.

The spouts can be installed only when the sorter is removed from the horizontal platform 60 of the stand. As shown in FIG. 8, a spout is inserted in a slot 62 by horizontally passing the narrower tubular body 64 through the open neck of the slot 62. One of the lower flanges 69 is then aligned with the keyway 63 while the other lower flange 69 is in the neck of the slot 62. This allows the spout to be moved downwardly so that the upper flange 68 rests on the platform 60 at the edge of the slot 62. By rotating the spout a portion of a turn, the lower flanges 69 will no longer be aligned with either the neck or the keyway 63 and the spout will be locked vertically in the platform 60.

The spout also includes a tab 70 extending from one side of the mounting portion 67 slightly above the level of the upper flange 68. The tab 70 will be received in an annular pocket 71 formed in the bottom of the shelf 16 about the shelf opening 30. When the coin sorter is in place on the platform 60, the tab 70 is received in the pocket 71 and the spout cannot be rotated to a position in which a lower flange 69 will align with the keyway 63. As a result, it is not possible to remove the spout once the coin sorter is on the stand.

We claim:

1. In a coin handling machine having a plurality of spaced stations at which coins are ejected, the combination comprising:

a shelf beneath the stations for supporting a collector at each station;

a plurality of collectors, one for each station;

a switch connected to disable the operation of the machine when actuated;

an actuator for the switch; and levers at the stations for engaging the actuator whereby the actuator is responsive to the presence of all of the collectors in place at all of the stations to actuate the switch when any one of the collectors is absent.

2. A coin handling machine in accordance with claim 1 wherein the collectors are drawers that rest on the shelf.

3. A coin handling machine in accordance with claim 1 wherein the collectors are chutes each having a bottom exit opening, and the shelf has openings that align with the exit openings in the chutes.

4. A coin handling machine in accordance with claim 3 together with bagging spouts disposed at the openings in the shelf.

5. A coin handling-machine in accordance with claim 1 wherein the actuator comprises a plate normally held in a neutral plane in which the plate does not actuate the switch, a lever is mounted at each station to move the plate from the neutral plane when released, and each collector engages a respective lever against release when the collector is in place at a station, whereby release of any of the levers by the absence of a collector will move the plate from the neutral plane and actuate the switch.

6. A coin handling machine in accordance with claim 5 together with a spring urging each lever toward engagement with the plate.

7. A coin handling machine in accordance with claim 5 wherein the spaced stations are arranged in a circular array, the plate is disposed in the center of the array, and the levers extend outwardly from the plate in a radial direction to each station.

8. A coin handling machine in accordance with claim 5 wherein each lever is pivoted intermediate its ends, with a first end beneath the plate for engagement therewith and the other end engageable with the collector, and a leaf spring bears against the underside of the first end to urge the first end into engagement with the plate.

9. A coin handling machine in accordance with claim 8 wherein the leaf springs at each lever are interconnected and conductive, the lever is conductive, and a portion of the collector that engages the lever is conductive, together with a contact extending into the collector adjacent its top to complete a circuit through coins in the collector when the level of coins reaches the contact.

10. In a coin handling machine having a plurality of spaced stations arranged in a circular array at which coins are ejected, the combination comprising:

a shelf beneath the stations for supporting a collector at each station;

a plurality of collectors, one for each station;

a switch disposed in the center of the array and connected to disable the operation of the machine when actuated;

an actuator for the switch disposed in the center of the array; and levers at the stations for engaging the actuator whereby the actuator is responsive to the presence of all of the collectors in place at all of the stations to actuate the switch when any one of the collectors is absent.

11. A coin handling machine in accordance with claim 10 wherein the actuator comprises a circular plate normally held in a neutral plane in which the plate does not actuate the switch, a spring-loaded pivot lever extends radially from the plate to each station to move the plate from the neutral plane when released, and each collector includes a projection that engages a respective lever against release when the collector is in place at a station, whereby release of any of the levers by the absence of a collector will move the plate from the neutral plane and actuate the switch.

12. A coin handling machine in accordance with claim 11 wherein each collector is wedge-shaped with an open top and straight sides converging toward the center of the array, a lower portion of each collector having a narrowed portion defined by straight sides.

13. A coin handling machine in accordance with claim 10 wherein the collectors are chutes each having an open top and a bottom exit opening, and the shelf has openings that align with the exit openings in the chutes, together with a horizontal platform supporting the shelf, the platform having a plurality of radial slots each aligned with a shelf opening, and a plurality of bagging spouts disposed in the slots.

14. A coin handling machine in accordance with claim 13 wherein each spout has a mounting portion that engages the slot with an interrupted flange on the mounting portion that cooperates with a keyway in the slot to allow insertions of the mounting portions in the slot and locking of the spout after insertion by rotation of the mounting portion.

15. A coin handling in accordance with claim 14 wherein the mounting portion of each spout has a projecting tab adopted to be received in a recess in the shelf when the shelf rests upon the platform, the recess engaging the tab to prevent rotation of the spout to remove a spout from the platform.

* * * * *